United States Patent [19]

Berzina

[11] Patent Number: 4,483,101

[45] Date of Patent: Nov. 20, 1984

[54] RETAINING STRAP FOR PRE-HUNG DOORS

[75] Inventor: James A. Berzina, Grand Island, Nebr.

[73] Assignee: Spelts-Schultz Lumber Co., Grand Island, Nebr.

[21] Appl. No.: 441,775

[22] Filed: Nov. 15, 1982

[51] Int. Cl.[3] ..... E06B 1/00

[52] U.S. Cl. ..... 49/380; 206/325

[58] Field of Search ..... 49/380; 206/325

[56] References Cited

U.S. PATENT DOCUMENTS

| | | | |
|---|---|---|---|
| 2,728,956 | 1/1956 | Jackson | 49/380 |
| 2,927,352 | 3/1960 | Chenoweth | 49/380 |
| 3,593,458 | 7/1971 | Wahlfeld | 206/325 X |

FOREIGN PATENT DOCUMENTS

| | | | |
|---|---|---|---|
| 519845 | 12/1955 | Canada | 49/380 |

*Primary Examiner*—Kenneth Downey

*Attorney, Agent, or Firm*—Harvey B. Jacobson

[57] ABSTRACT

An elongated flexible strap member is provided including a lateral projection on one end portion thereof. The projection equipped end portion of the strap member is insertable into the transverse lock body bore of a door with the projection on the strap member received within the end of the lock bolt bore of the door opening into the lock body bore. When the door is pre-hung within a door frame, the end portion of the strap not equipped with the projection is deflectable across one side surface of the door between the lock body bore and the free swinging edge of the door, across the interface between the door edge and the opposing door frame portion across the frame portion and thereafter deflectable across and securable to the surface of the door frame portion opposite the surface thereof which opposes the free swinging edge of the door. In this manner, a pre-hung door assembly, with the door properly shim spaced relative to the frame, may have the door thereof secured in closed position relative to the frame.

10 Claims, 4 Drawing Figures

RETAINING STRAP FOR PRE-HUNG DOORS

BACKGROUND OF THE INVENTION

Pre-hung doors are conventionally utilized in most new and remodeling building constructions and include a squared frame in which a door is pre-hung (hinged), properly shim spaced relative to opposing frame portions and nailed at the top and along both sides to the corresponding frame members. When installing such a pre-hung door the nails must be pulled and the nail holes in the door must be filled before the door can be painted or otherwise finished. Inasmuch as the nails which secure the door in position relative to the frame are sometimes difficult to remove and the nail holes must be filled before the door is painted or otherwise finished, a need exists for an improved means by which the door of a pre-hung door assembly may be secured in the closed position from the time it is completed as an assembled unit by the manufacturer until the time it is to be installed.

Examples of various different pre-hung door assemblies including different means for securing the doors thereof in closed positions relative to the associated frames are disclosed in U.S. Pat. Nos. 2,728,956, 2,913,777, 3,250,039, 3,411,240, 3,430,385, 3,593,458 and 3,875,700.

BRIEF DESCRIPTION OF THE INVENTION

The door retaining member or strap of the instant invention comprises merely an elongated strap member constructed of flexible material and including a lateral projection extending outwardly from one side of the strap member adjacent one end thereof and with the material of which the strap member is constructed being adapted to have an inexpensive staple driven therethrough. In addition, the strap member is further constructed of a material which enables it to be readily cut by a sharp manually supported cutting blade.

The main object of this invention is to provide an improved retaining strap for pre-hung doors.

Another object of this invention is to provide a means for securing the door of a pre-hung door assembly in closed position relative to the frame portion of the door assembly and which will be economical to use and represent a savings in time insofar as the manufacturer of the door assembly is concerned.

Still another important object of this invention is to provide a retaining strap for pre-hung doors in accordance with the preceding objects and which will enable a carpenter to more quickly install a pre-hung door assembly on the job.

A further object of this invention is to provide a door securing or retaining structure in accordance with the preceding objects and constructed in a manner which enables an associated door to be more quickly and readily released from a closed position relative to the associated frame and which eliminates the need to fill nail holes in the door preparatory to painting or otherwise finishing the door.

A final object of this invention to be specifically enumerated herein is to provide an apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
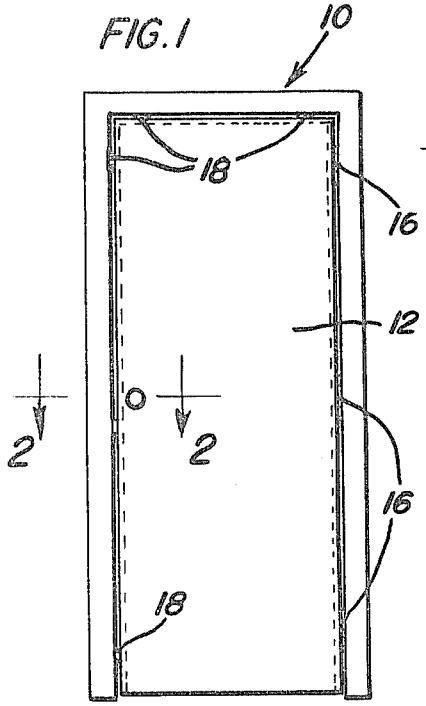
FIG. 1 is an elevational view of a pre-hung door assembly with the door portion thereof secured in a closed position within the frame component of the assembly through the utilization the door retaining strap of the instant invention.

With reference now more specifically to the drawings, the numeral 10 generally designates a pre-hung door assembly including a door 12 mounted within a doorframe or jamb 14 and hinged as at 16 to one side of the jamb 14. The top and opposite side edges of the door 12 are spaced relative to the corresponding sides of the frame 14 by clearance spacers 18. Conventionally, the door 12 includes a free swinging edge 20 remote from the hinged edge thereof and a transverse lock body bore 22 formed through the door 12 adjacent but spaced from the free swinging edge 20. The opposite ends of the bore 22 open through opposite side faces 24 and 26 of the door 12. In addition, the door 12 conventionally includes a lock bolt bore 28 formed therein and one end of the lock bolt bore opens into the lock body bore 22 while the other end of the lock bolt bore 28 opens outwardly through the free swinging edge 20. The frame or jamb 14 includes a door stop 30 extending peripherally thereabout. Also, the inside casing 32 is nailed to and extends about the inside periphery of the door frame or jamb 14.

Conventionally, the door 12 is nailed in the predescribed closed position by nails passing through both the opposite sides and the top of the door jamb 14 and embedded in the door 12. However, when these nails are removed during the mounting of the door assembly 10 in a wall opening such as that illustrated at 34, these nails must be removed and the nail holes in the door 12 must be filled before the door can be painted or otherwise finished.

Not only are the nails sometimes difficult to remove, but they represent considerable expense to the manufacturer of the door assembly 10 and also require considerable time to install.

The door retaining strap of the instant invention is referred to in general by the reference numeral 36 and includes an elongated flexible strap member 38 constructed of suitable material such as plastic. One end of the strap member 38 includes a truncated conical projection 40 projecting outwardly from one side thereof. The projection 40 may be hollow in order to allow the strap 36 to be manufactured through the utilization of a minimum amount of plastic material.

The end of the strap member 38 remote from the projection 40 gradually increases in thickness as at 42 and is provided with manual grip facilitating transverse projections 44. In addition, the end portion of the strap member 38 adjacent the projection 40 is provided with a pair of arrow point indicia 46 indicating transverse lines along which the strap member 38 ultimately will be cut upon installation of the door assembly 10 depending upon the set back of the bore 22 from the edge 20.

Figure 2:
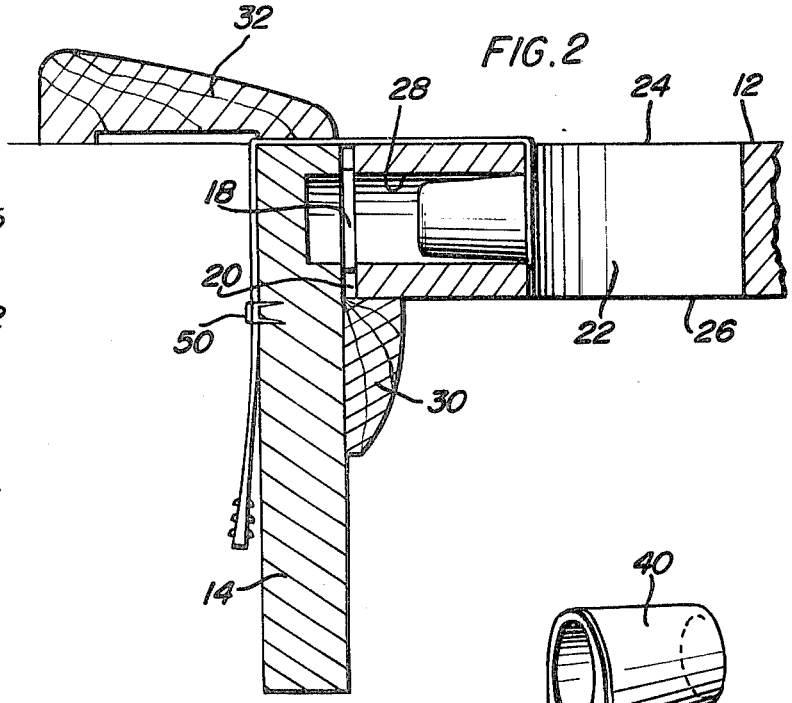
FIG. 2 is an enlarged fragmentary horizontal sectional view taken substantially upon the plane indicated by the section line 2—2 of FIG. 1 and with the front side of the casing installed on the frame or jamb.

When being constructed by the manufacturer, the assembly is constructed in the usual manner except that the door 12 is not nailed relative to the door frame or jamb 14. Instead, when the step of securing the door in the closed position is reached, the strap member 38 has the end thereof supporting the projection 40 displaced inward of the lock body bore 22 and the projection 40 is seated in the end of the bore 28 which opens into the bore 22, see FIG. 2. Then, the end of the strap member equipped with the projections or lugs 44 is gripped and deflected over the door face 24, across the interface between the free swinging edge and the opposing portion of the frame 14 and thereafter across the adjacent face of the jamb 14 remote from the edge 20, in which position the free end of the strap member 38 may be secured through the utilization of an inexpensive staple 50. Then, the lock side casing 32 is nailed in position.

Figure 3:
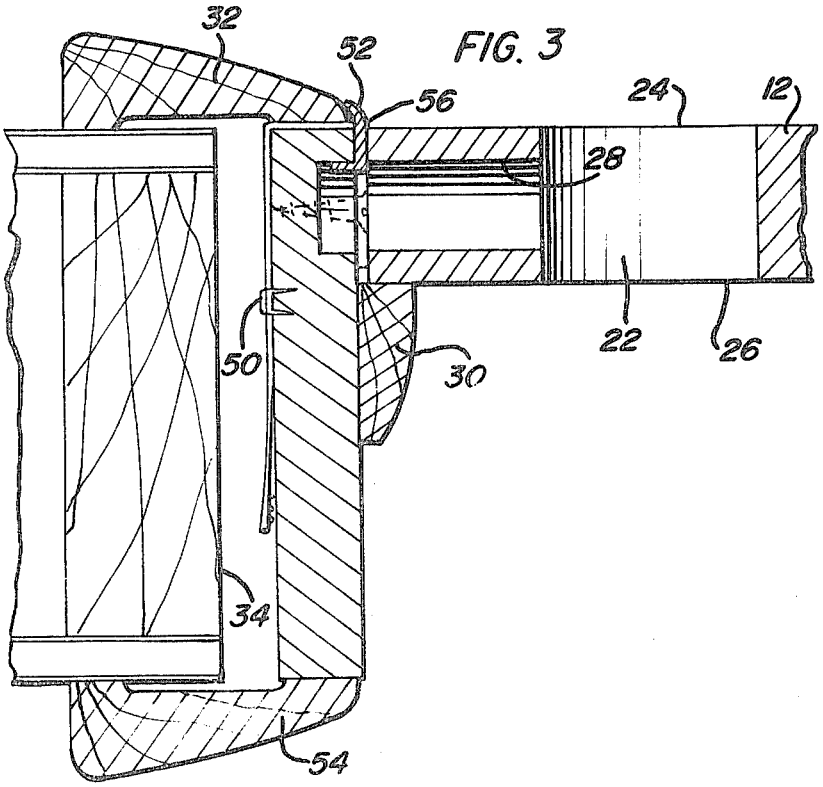
FIG. 3 is a fragmentary horizontal sectional view similar to FIG. 2 but illustrating the door assembly in full installed position within a wall opening and with the end of the retaining strap previously anchored relative to the door cut away and a door strike plate installed and covering the cut end of the strap.
Figure 4:
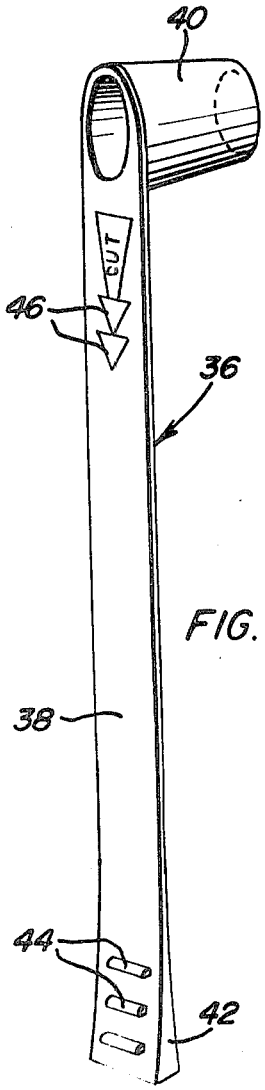
FIG. 4 is a perspective view of the retaining strap.

When it is desired to mount the assembly 10 during installation, the assembly 10 is merely placed in the rough opening 34, plumbed and the casing 32 is nailed in position. Thereafter, the strap member 38 is cut at 52, see FIG. 3, and the end thereof supporting the projection 40 is removed. Thereafter, the door is opened, the spacers 18 are removed and the jamb 14 is shimmed and secured in position, after which the opposite casing 54 may be nailed to the jamb 14 and opposing wall portions. Then, the door striker plate 56 may be secured in position. It will be noted that the striker plate 56 completely covers the cut end 52 of the strap member 38. Further, it is to be pointed out that the strap member 38 is quite thin and therefore does not interfere with proper spacing of the door 12 relative to the jamb 10 by the spacers 18.

When the strap member 38 is being installed, it is longitudinally tensioned, at least to some degree, in order that when it is secured in position of the staple 50 the tensioned strap member 38 will ensure securement of the door 12 in the closed position of the usual nails.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A pre-hung door assembly including a door frame and a door hingedly supported from said frame and including a free swinging edge opposing a corresponding marginal portion of said frame, said door having a lock body bore formed therein adjacent said free swinging edge and opening outwardly of at least one side face of said door and also a lock bolt bore formed therein opening through the free swinging edge of the door at one end and into the lock body bore at the other end, a retaining strap comprising an elongated strap member including a lateral outward projection on one end portion, said one end portion projecting into said lock body bore with said projection projecting into the end of said lock bolt bore opening into said lock body bore, said strap member extending outwardly of said lock body bore, being directed across said one side face of said door, toward and across the interface between the free swinging edge of the door and the opposing frame portion and across the frame portion to the side thereof remote from the free swinging edge and then being directed at least partially across and secured to the last mentioned side of the frame portion with the strap member at least substantially free of slack portions thereof extending between said projection and the portion of the strap member secured to the frame portion.

2. The door assembly of claim 1 wherein said strap member, between said projection and portions secured to said frame portion, is longitudinally tensioned.

3. The door assembly of claim 1 wherein said portion of said strap member secured to said frame portion is stapled thereto.

4. The door assembly of claim 1 wherein said strap is constructed of a material readily cut by a sharp manual cutting tool.

5. The door assembly of claim 1 wherein the other end portion of said strap includes means adjacent the free end thereof to facilitate a manual grip on said strap member other end.

6. The door assembly of claim 1 wherein said strap member, in the area thereof crossing said inner face, includes a pair of longitudinally spaced transverse cutting zone indicating indicia.

7. The door assembly of claim 1 wherein said strap member, between said projection and portions secured to said frame portion, is longitudinally tensioned, said portion of said strap member secured to said frame portion being stapled thereto.

8. The door assembly of claim 7 wherein said strap is constructed of a material readily cut by a sharp manual cutting tool.

9. The door assembly of claim 8 wherein the other end portion of said strap includes means adjacent the free end thereof to facilitate a manual grip on said strap member other end.

10. The method of securing the door component of a pre-hung door assembly in closed position and wherein the assembly includes a door frame, a door hingedly supported from the frame, a lock body bore formed transversely through the door spaced slightly inwardly of the free swinging edge of the door and a lock bolt bore formed in the door having one end opening into the lock body bore and the other end opening outwardly through said free swinging edge, said method comprising providing an elongated flexible strap member having a laterally outwardly projecting abutment on one end portion thereof, inserting said one end portion into one end of said lock body bore with said abutment projecting into said one end of said lock bolt bore and the other end of said strap member projecting outwardly of said one end of said lock body bore, deflecting said other strap member end across the interface between said free swinging edge and the opposing frame portion and thereafter across the far side of said opposing frame portion opposite the side thereof opposed by said free swinging edge with said strap member in a lengthwise tensioned state, and thereafter securing said other strap member end to said far side.

* * * * *